US008739715B2

(12) United States Patent
Cohen

(10) Patent No.: US 8,739,715 B2
(45) Date of Patent: Jun. 3, 2014

(54) SUBLIMATION EMBROIDERY

(76) Inventor: Avi Cohen, Los Angeles, CA (US)

( * ) Notice: Subject to any disclaimer, the term of this patent is extended or adjusted under 35 U.S.C. 154(b) by 866 days.

(21) Appl. No.: 12/583,421

(22) Filed: Aug. 20, 2009

(65) Prior Publication Data

US 2011/0041741 A1 Feb. 24, 2011

(51) Int. Cl.

| | |
|---|---|
| ***D05B 3/00*** | (2006.01) |
| ***D05C 17/00*** | (2006.01) |
| *B32B 7/08* | (2006.01) |

(52) U.S. Cl.

USPC ..... 112/475.18; 112/439; 428/196

(58) Field of Classification Search

USPC ..... 428/40.1, 41.8, 102, 354, 196; 2/244; 112/475.18, 439, 475.01, 475.08, 112/475.09, 475.17

See application file for complete search history.

(56) References Cited

U.S. PATENT DOCUMENTS

| | | | | |
|---|---|---|---|---|
| 6,321,672 | B1 | 11/2001 | Dudek, II | |
| 2006/0219733 | A1 * | 10/2006 | Gardner et al. | 221/309 |
| 2008/0265084 | A1 * | 10/2008 | Hammer et al. | 242/557 |
| 2009/0025123 | A1 * | 1/2009 | Weedlun et al. | 2/244 |
| 2009/0075075 | A1 * | 3/2009 | Abrams | 428/354 |
| 2009/0238978 | A1 * | 9/2009 | Marino et al. | 427/261 |
| 2009/0286039 | A1 * | 11/2009 | Weedlun et al. | 428/114 |
| 2010/0035029 | A1 * | 2/2010 | Ngo et al. | 428/196 |
| 2010/0178445 | A1 * | 7/2010 | Shen et al. | 428/40.1 |

* cited by examiner

*Primary Examiner* — Ismael Izaguirre

(57) ABSTRACT

A colored embroidered pattern is formed on a fabric by positioning a stabilizer prior to the embroidery process on the top surface of the fabric. The stabilizer extends beyond at least a portion of the embroidered pattern such that it blocks sublimating dyes from binding to the fabric during the sublimation process. Excess stabilizer is then removed.

18 Claims, 4 Drawing Sheets
(2 of 4 Drawing Sheet(s) Filed in Color)

SUBLIMATION EMBROIDERY

CROSS-REFERENCE TO RELATED APPLICATIONS

Not applicable

STATEMENT REGARDING FEDERALLY SPONSORED RESEARCH OR DEVELOPMENT

Not applicable.

BACKGROUND OF THE INVENTION

1. Field of the Invention

The present invention relates to embroidered artworks and, more particularly, to an improved method for making an embroidered fabric having a sublimated dye thereon.

2. Description of Related Art

Embroidery is the art of decorating material, usually a textile fabric, by means of a needle and thread. Embroidered patterns are usually multi-colored such that different-colored threads must be stitched in the embroidered pattern. This means that for one embroidered pattern, the embroidery thread must be changed multiple times.

Dudek, II, U.S. Pat. No. 6,312,672 described a method for producing polychromatic embroidery that requires the use of only a single colored (or white) thread for embroidering the pattern on the fabric. Dudek '672 states that by using a multi-color process for sublimation printing, subtle color blends and photorealism were realized that could not otherwise be achieved employing prior art embroidery methods. Yet, with such techniques, there is often difficulty in aligning the sublimation paper with the embroidered image on the fabric. In some instances, part or all of the periphery of the embroidered design remains monochromatic (e.g., white around the edges). In other instances, the excess sublimation dyes undesirably bleed onto the underlying fabric. While templates may be useful to attempt to block the sublimation dyes from sublimating into the underlying fabric, such templates cannot be used to create finer details, such as flowers, letters, hair, sharp angles, etc. Thus, an improved process for sublimation embroidery is desired.

BRIEF SUMMARY OF THE INVENTION

The present invention is directed to an improved method for making fabrics having a color embroidered pattern thereon in which the color is formed using sublimation. The sublimation method results in an embroidered pattern having distinctive and unique color qualities.

In general, a stabilizer is applied on a first top surface of the fabric. Next, an embroidered pattern is embroidered onto the top surface of the fabric. The embroidery thread or yarn is substantially light in color and is capable of binding sublimating dyes. The embroidered pattern is positioned over the stabilizer so that the stabilizer extends beyond at least a portion of the embroidered pattern. Preferably, the stabilizer extends beyond the entire periphery of the embroidered pattern and/or in the internal openings of the pattern. The embroidered pattern (which is substantially light in color) is then sublimated with one or more sublimating dyes (preferably four) to form a colored embroidered pattern. Excess stabilizer is then removed, typically by washing away or cutting away the stabilizer.

In one aspect, the present invention is well suited for sublimating one or more dyes onto an embroidered pattern having very fine details, such leaves, branches, flower petals, or individual hairs on a head.

In another aspect, the present invention is directed to an intermediate product in the overall sublimation embroidery process described herein. More specifically, the present invention is directed to a decorative embroidered fabric comprising a fabric having a first face and a second face, wherein the first face of the fabric has a first stabilizer thereon, and wherein an embroidered pattern is formed on the first face of said fabric such that said first stabilizer extends beyond at least a portion of the embroidered pattern.

In another aspect, the present invention is directed to an embroidery kit comprising a fabric; embroidery thread or yard; a stabilizer; and a paper having a pattern of one or more sublimating dyes thereon. Instructions are provided to the user such that the stabilizer is applied to the top face of the fabric followed by embroidery on the top face of the fabric followed by sublimating the embroidered pattern with one or more sublimating dyes.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The file of this patent contains at least one photograph executed in color. Copies of this patent or patent application publication with color photographs will be provided by the Office upon request and payment of the necessary fee.

DETAILED DESCRIPTION OF PREFERRED EMBODIMENT

The present invention is directed to a method for forming a colored embroidered pattern on a fabric. In general, a stabilizer is applied on a first top surface of the fabric. An embroidered pattern is embroidered onto the top surface of the fabric. The embroidery thread or yarn is substantially light in color and is capable of binding sublimating dyes. Typically, the embroidery thread has a high polyester content, e.g., greater than 50%, 60%, 70%, 80%, or 90%, and is most preferably 100% polyester. The embroidered pattern is positioned over most of the stabilizer so that the stabilizer extends beyond at least a portion of the embroidered pattern. The embroidered pattern (which is substantially light in color) is then sublimated with one or more sublimating dyes to form a colored embroidered pattern. Excess stabilizer is then removed, typically by washing away or cutting away the stabilizer. The overall process is depicted in FIG. 1.

In the present invention, the fabric 10 comprises any suitable fabric for embroidery purposes and is non-limiting. The fabric includes any material comprising a network of natural or artificial fibers, including wool, linen, hemp, cotton, polyester, or other material. The fabric may be formed, for example, by weaving, knitting, crocheting, knotting, or pressing the fibers together. The fabric may be heavy-duty, for example in the case of canvas, or relatively lightweight.

The fabric 10 includes both a first surface (in which the embroidery will be applied) and an opposing second surface. In the present invention, the stabilizer 20 is positioned on the first surface as shown in FIG. 1. Exemplary stabilizer materials include the so-called cut-away, tear-away, or wash-away stabilizers, or combinations thereof. The stabilizer is preferably made of a material that is capable of binding to sublimating dyes, such as a polyester. Typically, the stabilizer has a high polyester content, e.g., greater than 50%, 60%, 70%, 80%, or 90%, and is most preferably 100% polyester. The stabilizer is typically comprised of a water soluble backing, and is about 1.2 ounces per square yard. Various sizes and shapes of the stabilizer may be used, depending upon the embroidery pattern as discussed more fully below. A preferred wash-away stabilizer is white in color and is commercially available from STC QST LLC (Los Angeles, Calif.) under the product code #412. A preferred tear-away stabilizer is commercially available from Marathon West (Los Angeles, Calif.) under the product code #2t461 (EZ T-AWAY). It will be appreciated that conventional stabilizers are typically placed on the back surface or second surface of the fabric during a conventional embroidery process and not on the front surface or first surface of the fabric as described herein.

Figure 1:
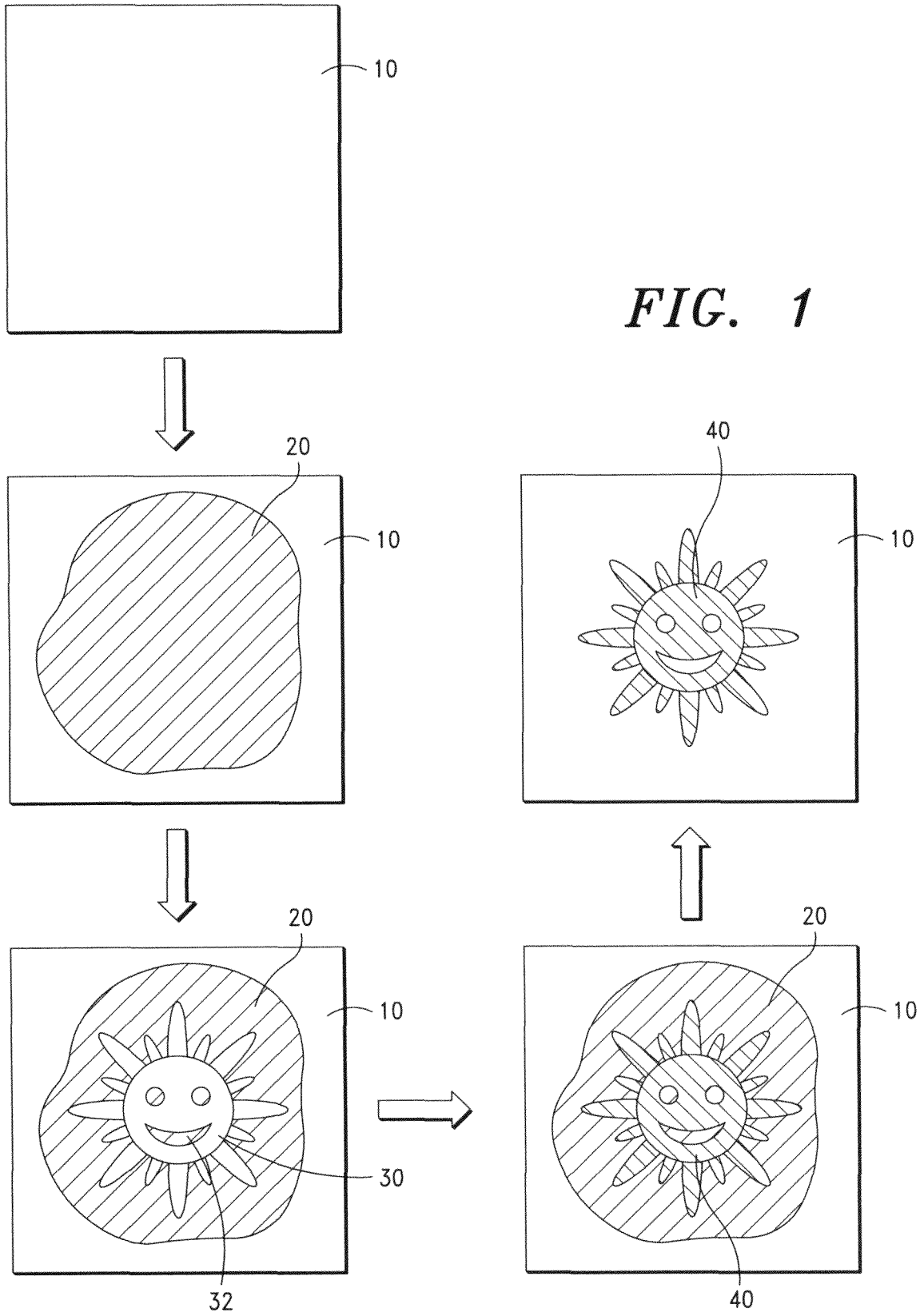
FIG. 1 is a flow diagram illustrating the overall embroidery and sublimation process in accordance with the present invention.

As shown in FIG. 1, an embroidered pattern 30 is formed on the first surface of the fabric 10. For illustration purposes only, the embroidered pattern is depicted in FIG. 1 is a smiling sun comprising a embroidered circle having three openings where the eyes and mouth are formed and a plurality of embroidered sun rays extending from the embroidered circular. It will be appreciated that any embroidered pattern may be used in conjunction with the present invention (e.g., geometric objects, lettering, numbering, landscapes, human, animals, commercial logos, and the like). The embroidered pattern 30 is formed from thread or yarn using techniques known to those skilled in the art. In general, the embroidered pattern comprises a decorative design made by either hand-sewing or machine needlework. Embroidery may also incorporate other materials such as metal strips, pearls, beads, quills, and sequins. Exemplary stitches include the chain stitch, buttonhole stitch, running stitch, satin stitch, cross stitch, and the like. For example, the basic embroidery technique includes running stitches, satin stitches, and fill stitches sewn on a substrate. An embroidering apparatus is operated to move an embroidery frame, which has fabric held thereon to be embroidered, in the X-direction and Y-directions relative to the vertically reciprocating needle, thereby to form the embroidery stitches on the work. Embroidery includes both the "on top of" and "through" types.

The thread or yarn used to form the embroidered pattern 30 is one that is suitable for sublimation. As such, the thread or yard preferably has two properties. First, the thread or yarn forms an embroidered pattern which is substantially light in color. That is, the embroidered pattern is one which comprises white, clear, or light colors suitable for further sublimation printing thereon. Exemplary light colors include pastels, which are generally defined as any pale shade having relatively low color saturation. Preferably, the embroidered pattern is monochromatic, which includes pure white patterns. Second, the thread or yarn comprises a material capable of binding the sublimating dyes. Typically, the thread or yarn has a high polyester content, e.g., greater than 50%, 60%, 70%, 80%, or 90%, and most preferably 100% polyester. In general, sublimation transfer generally produce brighter colors retain more dye when the polyester content is high. Thus, the yard or thread may need to be soaked or sprayed with a polyester-based prepping liquid in order to facilitate sublimation transfer.

The embroidered pattern 30 is preferably positioned so that the stabilizer 20 extends beyond at least a portion of the embroidered pattern. Typically, the stabilizer 20 is positioned on the fabric 10 so the stabilizer extends beyond the entire periphery of the embroidered pattern 30. As illustrated in FIG. 1, the stabilizer 20 extends beyond the periphery of the central circle of the sun, as well as along the sun rays extending from the central circle. The stabilizer 30 also preferably extends beyond the embroidered pattern so that the most, preferably all of the internal openings 32 of the embroidered pattern (e.g., the eyes and mouth of the smiling sun of FIG. 1) are covered by the stabilizer 30.

As shown in FIG. 1, after the embroidered pattern 30 is formed, one or more sublimating dyes are applied to the embroidered pattern to form a colored embroidered pattern 40. While FIG. 1 illustrates the colored embroidered pattern 40 with shading, it will be appreciated to those skilled in the art that the actual colored embroidered pattern 40 has the visual properties of sublimated embroidery. Often, this takes the form of a photo-real quality or a "tie-dye" effect.

During the sublimation step of the present invention, one or more sublimating dyes are applied to the embroidered pattern 30, for example, a four-color process such as one involving cyan, magenta, yellow, and black. In general, the sublimation process creates a color image on the embroidery thread or yard comprising the embroidered pattern 30 by actually dyeing the thread or yarn. When a sublimation transfer is heat applied, the heat and pressure cause the sublimation dye (typically on a sublimation paper) to change from a solid directly into a gas and enter the fibrous substrate. While in its gaseous form, the sublimation dye enters the fibers of the embroidered pattern, thereby dyeing it. Because the sublimation dye penetrates the fibers of the embroidery, the colored embroidered pattern 40 created is essentially permanent and substantially non-destructible. Importantly, in the present invention, the excess dyes sublimate onto the surrounding stabilizer 20 and not onto the surrounding fabric 10.

The colored embroidered pattern may comprise any sort of monochromatic or polychromatic design. For example, the colored embroidered pattern may comprise colored geometric objects (e.g., a pattern of squares, circles, stars, peace signs, rainbows, and the like), lettering, numbering, landscapes, human, animals, commercial logos, or combinations thereof. In one aspect, the colored embroidered pattern has a photo-real quality. In another, the patterns have a "tie-dye" effect with one or more of the colors.

During the sublimation process, the stabilizer 20 prevents the sublimating dye from penetrating into the underlying fabric 10 at the boundary between fabric 10 and the colored embroidered pattern 30. The stabilizer 20 is especially useful for preventing the sublimating dye from penetrating into the fabric 10 in areas where the embroidered pattern has internal openings 32. Thus, by using the stabilizer 20, the dye is capable of forming a colored embroidered pattern 40 having unique and desirable patterns, especially those involving small or fine features, such as a single hair, leaf, branch, etc.

As shown in FIG. 1, after the sublimating dyes are applied, the stabilizer 20 is removed using conventional techniques. In the case of wash-away stabilizers, the fabric is removed by hand or machine washing. In the case of cut-away stabilizers, the stabilizer is removed by cutting away the stabilizer at the periphery and internal openings 32 of what is now the colored embroidered pattern 40. The fabric 20 thus has a colored embroidered pattern 40 formed using a sublimation dye process in which the stabilizer 30 is not visible when viewed from the first surface of the fabric 10.

In another aspect of the present invention, as discussed above, it has been found that combinations of stabilizers may optimize the sublimation process. For example, when sublimating onto a fabric which is generally light in color, a plurality of stabilizers may be used. The stabilizers may be on the same or different materials. For example, a combination of a wash-away stabilizer and a tear-away stabilizer ensures that the dye does not penetrate through the stabilizer to the underlying fabric. In a preferred aspect, two tear-away stabilizers are used on conjunction with one wash-away stabilizer. When sublimating onto a dark fabric, it is generally sufficient to use a single stabilizer.

Example 1

In this example, the present invention was used to form a colored embroidered pattern comprising a generally horse-shoe like embroidered pattern having a plurality of geometric designs sublimated thereon. As shown in FIG. 2, the geometric design comprised stars, peace signs, and the like.

Figure 2A:
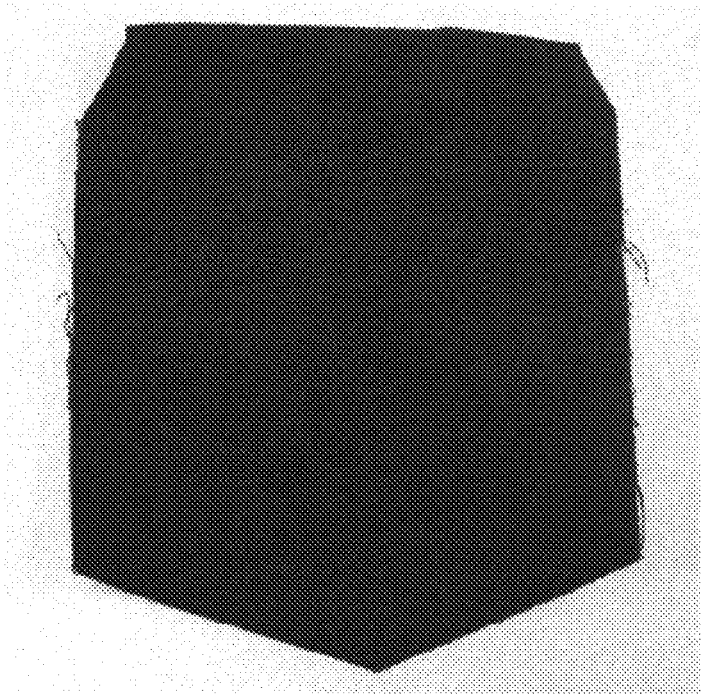
FIG. 2A-2F is a panel of photographs illustrating the various steps in the overall embroidery and sublimation process in accordance with the present invention.
Figure 2B:
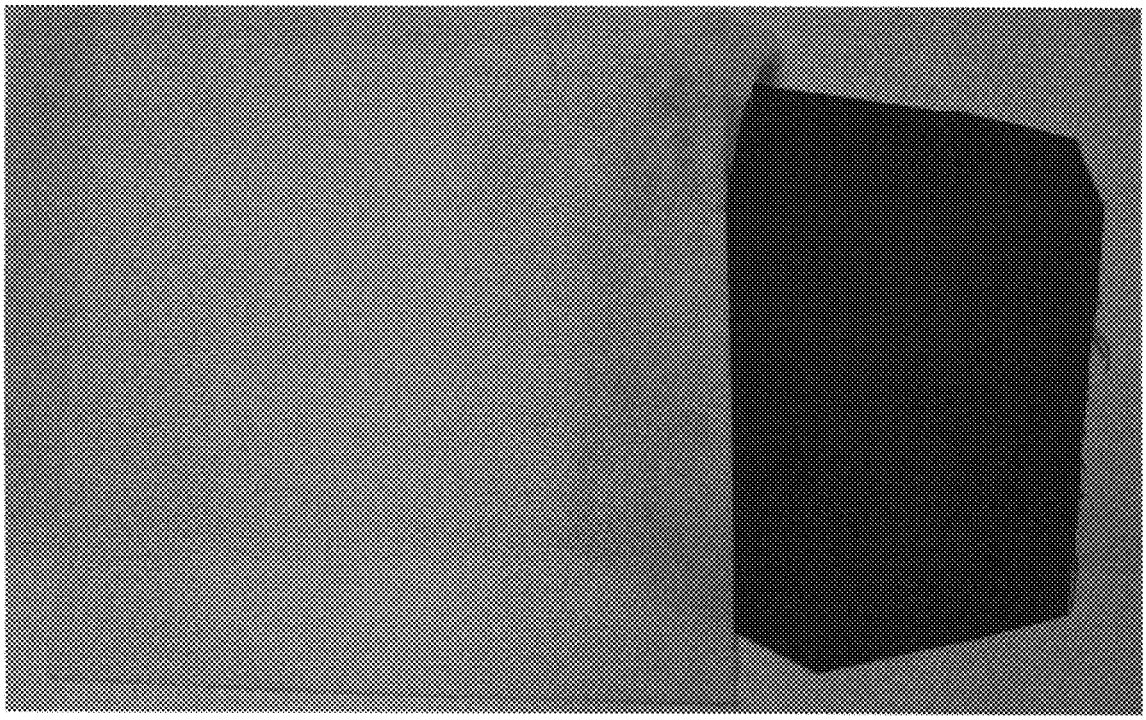
Figure 2C:
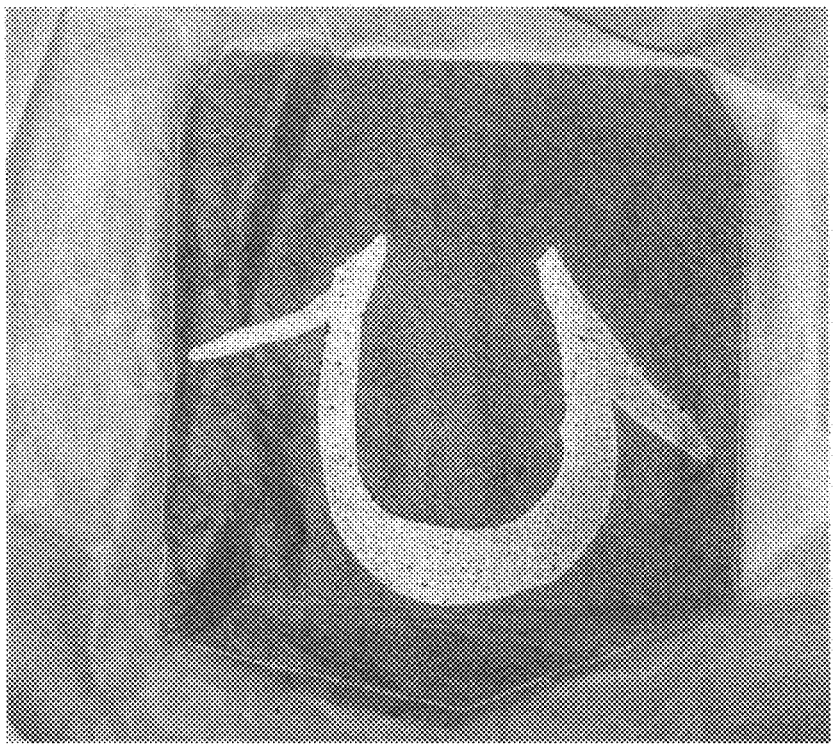
Figure 2D:
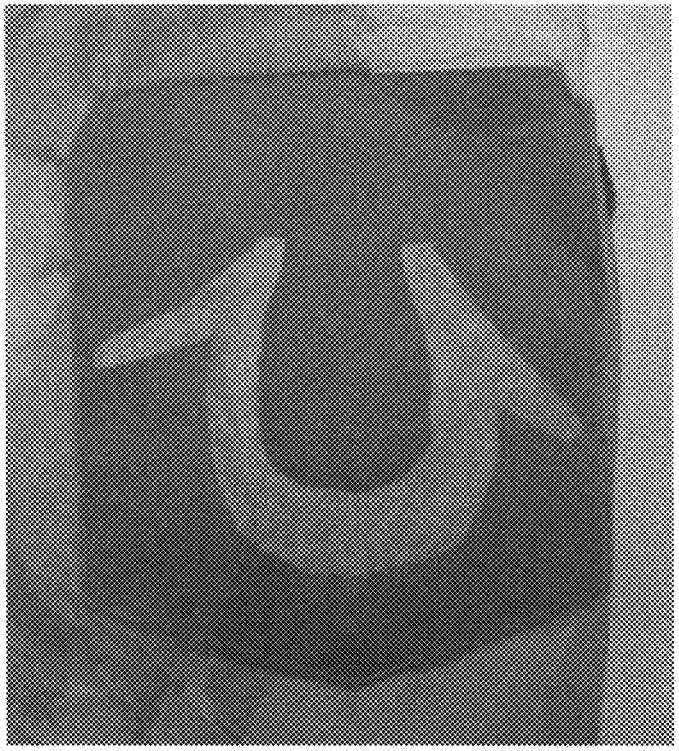
Figure 2E:
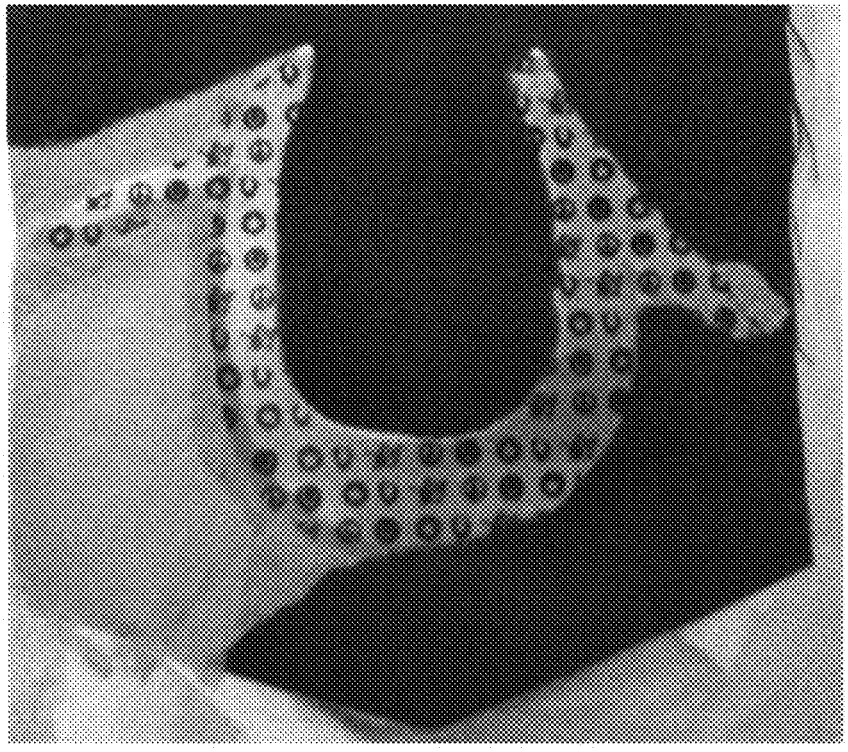
Figure 2F:
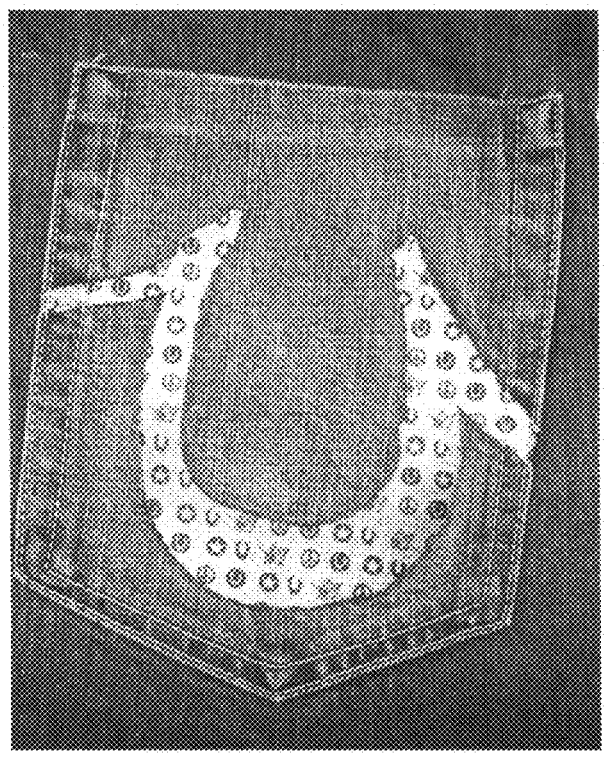

FIG. 2A illustrates a small piece of denim fabric used to form a pocket. In FIG. 2B, a Pallone wash-away stabilizer is placed over the denim fabric. The stabilizer is 100% polyester and is commercially available from STC QST LLC (Los Angeles, Calif.) under the product number #412. In FIG. 2C, a horse-shoe like embroidered pattern is embroidered into the fabric and the stabilizer. In FIG. 2D, sublimation paper having a colored pattern of sublimating dyes thereon is applied face down to the embroidered pattern. A tack spray or pressure sensitive adhesive is used to hold the sublimation paper in place on top of the embroidered pattern. A tissue paper (brown) is placed on top of the sublimation paper so that stabilizer will not melt onto the sublimating heat-transfer machine. If the tissue paper is not used, the Pallone stabilizer often melts, requiring cleaning of the sublimation heat-transfer machine. The sublimation paper is heat-pressed at about 380 to 420° F. (preferably about 400° F.) for about 30 to 60 seconds, preferably about 20 to 40 seconds sufficient to transfer the sublimation dyes from the paper onto the embroidered pattern. The preferred sublimation paper is the JetCol THR 2000 paper commercially available from Jantex Inks (Pico River, Calif.) and manufactured by Coldenhove Papier of the Netherlands. As shown in FIG. 2E, the sublimation paper (and brown tissue paper) is then removed to reveal a colored embroidered pattern. The dark areas on the left side of the horse-shoe design of FIG. 2E illustrates where the sublimation dies are being transferred onto the stabilizer, instead of onto the surrounding fabric. After hand or machine washing using warm water (no detergent is needed), the excess wash-away stabilizer is removed as illustrated in FIG. 2F.

From the foregoing, it will be seen that this invention is one well adapted to attain all ends and objectives herein-above set forth, together with the other advantages which are obvious and which are inherent to the invention. Since many possible embodiments may be made of the invention without departing from the scope thereof, it is to be understood that all matters herein set forth or shown in the accompanying drawings are to be interpreted as illustrative, and not in a limiting sense. While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A fabric bearing a colored embroidered pattern made by the process comprising the steps of:
- placing a first stabilizer comprised of polyester fibers on a first surface of said fabric;
- embroidering said first surface of said fabric to form an embroidered pattern using an embroidery thread that is substantially light in color and that binds to sublimating dyes, wherein said first stabilizer extends beyond at least a portion of said embroidered pattern;
- sublimating one or more sublimating dyes onto said embroidered pattern to form a colored embroidered pattern;
- removing at least a portion of said first stabilizer.

2. The fabric of claim 1 wherein said one or more sublimating dyes are selected from the group consisting of cyan, magenta, yellow, black, or combinations thereof.

3. The fabric of claim 1 wherein said first stabilizer is selected from the group consisting of a wash-away stabilizer, tear-away stabilizer, or combinations thereof.

4. The fabric of claim 1 wherein said sublimating step comprises:
- providing a paper having a printed image of one or more sublimating dyes of a colored pattern in registerable contact with the embroidered pattern and applying pressure;
- heating the one or more sublimating dyes to a temperature sufficient to sublimate the one or more sublimating dyes; and then
- separating the paper and said embroidered pattern to form said colored embroidered pattern.

5. The fabric of claim 1 wherein said colored embroidered pattern comprises a polychromatic pattern.

6. The fabric of claim 1 wherein said colored embroidered pattern comprises one or more colors overlapping each other to achieve a photo-real quality in said embroidered pattern.

7. The fabric of claim 1 wherein said embroidered pattern is comprised of polyester fibers.

8. The fabric of claim 1 wherein said fabric is dark in color and wherein a second stabilizer is placed on said first surface of said fabric prior to said embroidering step.

9. The method of claim 1 wherein said first stabilizer and a second stabilizer are comprised of different materials.

10. A decorative embroidered fabric comprising:
- a fabric having a first face and a second face,
- wherein said first face of said fabric has a first stabilizer comprised of polyester fibers thereon;
- wherein an embroidered pattern is formed on said first face of said fabric such that said first stabilizer extends beyond at least a portion of said embroidered pattern.

11. The decorative embroidered fabric of claim 10 wherein said embroidered pattern is colored with a sublimating dye.

12. An embroidery kit comprising:
- a fabric;
- embroidery thread or yard;
- a stabilizer comprised of polyester fibers; and
- a paper having a pattern of one or more sublimating dyes thereon.

13. A method for forming a colored embroidered pattern on a fabric comprising the steps of:
- placing a first stabilizer, comprised of polyester fibers and selected from the group consisting of a wash-away stabilizer, tear-away stabilizer, or combinations thereof, on a first surface of said fabric;

embroidering said first surface of said fabric to form an embroidered pattern using an embroidery thread that is substantially light in color and that binds to sublimating dyes, wherein said first stabilizer extends beyond at least a portion of said embroidered pattern;

sublimating one or more sublimating dyes, wherein one or more sublimating dyes are selected from the group consisting of cyan, magenta, yellow, black, or combinations thereof, onto said embroidered pattern to form a colored embroidered pattern;

removing at least a portion of said first stabilizer;

wherein said sublimating step comprises providing a paper having a printed image of one or more sublimating dyes of a colored pattern in registerable contact with the embroidered pattern and applying pressure, heating the one or more sublimating dyes to a temperature sufficient to sublimate the one or more sublimating dyes; and then separating the paper and said embroidered pattern to form said colored embroidered pattern; and wherein said colored embroidered pattern is polychromatic, and comprises one or more colors overlapping each other to achieve a photo-real quality in said embroidered pattern.

14. The method of claim 13, wherein said embroidered pattern is comprised of polyester fibers.

15. The method of claim 13 wherein said fabric is dark in color and wherein a second stabilizer is placed on said first surface of said fabric prior to said embroidering step.

16. The method of claim 15 wherein said first stabilizer and a second stabilizer are comprised of different materials.

17. The method of claim 13 wherein said stabilizer extends beyond all of said embroidered pattern so that the periphery of said embroidered pattern is in contact with said stabilizer.

18. The method of claim 13 wherein said embroidered pattern has an internal opening, and said stabilizer extends into said internal opening.

* * * * *